US010638580B2

(12) United States Patent
Wu et al.

(10) Patent No.: US 10,638,580 B2
(45) Date of Patent: Apr. 28, 2020

(54) MULTI-MODE DIMMING CONTROL METHOD AND DIMMING CIRCUIT

(71) Applicant: Delta Electronics,Inc., Taoyuan, Taiwan (CN)

(72) Inventors: Que Wu, Taoyuan (CN); Xiaoping Fu, Taoyuan (CN); Kaibin Zheng, Taoyuan (CN); Xinghua Zhang, Taoyuan (CN)

(73) Assignee: Delta Electronics,Inc., Taoyuan, Taiwan (CN)

( * ) Notice: Subject to any disclaimer, the term of this patent is extended or adjusted under 35 U.S.C. 154(b) by 0 days.

(21) Appl. No.: 16/391,372

(22) Filed: Apr. 23, 2019

(65) Prior Publication Data

US 2019/0394844 A1 Dec. 26, 2019

(30) Foreign Application Priority Data

Jun. 20, 2018 (CN) ..... 2018 1 0639579

(51) Int. Cl.
*H05B 45/37* (2020.01)
*H05B 45/10* (2020.01)

(52) U.S. Cl.
CPC ..... *H05B 45/37* (2020.01); *H05B 45/10* (2020.01)

(58) Field of Classification Search
CPC ..... H05B 33/0815; H05B 33/0845; H05B 45/37; H05B 45/10
See application file for complete search history.

(56) References Cited

U.S. PATENT DOCUMENTS

2014/0062319 A1* 3/2014 Huang ..... H05B 33/0815 315/186
2014/0252990 A1* 9/2014 Maru ..... H02M 3/33507 315/307
2015/0054420 A1* 2/2015 Hiramatu ..... H05B 33/0815 315/210
2017/0251532 A1* 8/2017 Wang ..... H05B 33/0818
2018/0267395 A1* 9/2018 Yamada ..... G03B 21/2053
2019/0110349 A1* 4/2019 Tsukahara ..... H05B 37/0209
2019/0159310 A1* 5/2019 Yang ..... H05B 33/0818

FOREIGN PATENT DOCUMENTS

CN 101592965 B 7/2014
CN 105120575 A 12/2015

* cited by examiner

*Primary Examiner* — Raymond R Chai
(74) *Attorney, Agent, or Firm* — Yunling Ren

(57) ABSTRACT

The present disclosure provides a multi-mode dimming control method and a dimming circuit. The multi-mode current control method includes: receiving a dimming signal, and controlling the dimming circuit to be operated in a plurality of modes in an arbitrary order according to the dimming signal, wherein the plurality of modes include any two or all of a first dimming mode, a second dimming mode, and a third dimming mode. Also, the dimming circuit can be operated in different combinations of different modes according to actual needs, so that the requirements of a wide dimming range and a low output current ripple can be realized.

15 Claims, 10 Drawing Sheets

MULTI-MODE DIMMING CONTROL METHOD AND DIMMING CIRCUIT

CROSS REFERENCE

This application is based upon and claims priority to Chinese Patent Application No. 201810639579.4, filed on Jun. 20, 2018, the entire contents thereof are incorporated herein by reference.

TECHNICAL FIELD

The present disclosure relates to the field of lighting technology, and in particular, to a multi-mode dimming control method and a dimming circuit.

BACKGROUND

For occasions such as stadiums, lighting equipment is essential for live broadcast or playback of high-speed cameras. When performing slow-motion playback, it is necessary to achieve, for example, 1000 pictures per second without flicker, which requires low current ripple of the dimming circuit of the lighting equipment. And the dimming range of the dimming circuit needs to be wide enough to meet the requirements of different illuminations.

Generally, the conventional method of the dimming circuit is usually to control output feedback voltage or peak current. The former introduces power frequency ripple due to the accuracy of sampling resistance, and the dimming depth cannot be achieved. The latter can achieve lower power frequency ripple of the output current, however, with the depth of dimming, the peak current reference has a large error which makes that the dimming range cannot be wide enough to meet different requirements. Therefore, the existing dimming technology cannot meet the requirements of a wide dimming range and a low output current ripple.

It should be noted that the information disclosed in the background section above is only for enhancing the understanding of the background of the present disclosure, and thus may include information that does not constitute prior art known to those of ordinary skill in the art.

SUMMARY

According to a first aspect of the present disclosure, there is provided a multi-mode dimming control method for a dimming circuit, the dimming circuit including at least one main switch, wherein the method includes: receiving a dimming signal; controlling the dimming circuit to be operated in a plurality of modes in an arbitrary order according to the dimming signal, the plurality of modes including any two or all of a first dimming mode, a second dimming mode, and a third dimming mode; in the first dimming mode, generating a first control signal according to the dimming signal, generating a first peak current reference according to the first control signal, and controlling an output current of the dimming circuit according to the first peak current reference; in the second dimming mode, generating a second control signal according to the dimming signal, setting a second current peak reference, and controlling a turn-off time of the main switch according to the second peak current reference and the second control signal, to control the output current of the dimming circuit; and in the third dimming mode, generating a third control signal according to the dimming signal, setting a third current peak reference, and chopping the third peak current reference according to the third control signal to control the output current of the dimming circuit.

According to a second aspect of the present disclosure, there is provided a dimming circuit, including: a power conversion unit including at least one main switch; a dimming signal processor, configured to receive a dimming signal, and generate a control signal according to the dimming signal; a dimming controller electrically connected to the dimming signal processor, and configured to generate a driving signal according to the control signal, and output the driving signal to the main switch; wherein the dimming circuit is configured to be operated in a plurality of modes in an arbitrary order, the plurality of modes include any two or all of a first dimming mode, a second dimming mode, and a third dimming mode, in the first dimming mode, the dimming signal processor is configured to generate a first control signal according to the dimming signal, and the dimming controller is configured to generate a first peak current reference according to the first control signal to control an output current of the dimming circuit; in the second dimming mode, the dimming signal processor is configured to generate a second control signal according to the dimming signal, and the dimming controller is configured to set a second peak current reference, and control a turn-off time of the main switch according to the second peak current reference and the second control signal, to control the output current of the dimming circuit; and in the third dimming mode, the dimming signal processor is configured to generate a third control signal according to the dimming signal, the dimming controller is configured to set a third peak current reference, and chop the third peak current reference according to the third control signal to control the output current of the dimming circuit.

It should be understood that both the foregoing general description and the following detailed description are exemplary and explanatory only and are not restrictive to the disclosure.

DETAILED DESCRIPTION

Figure 1:
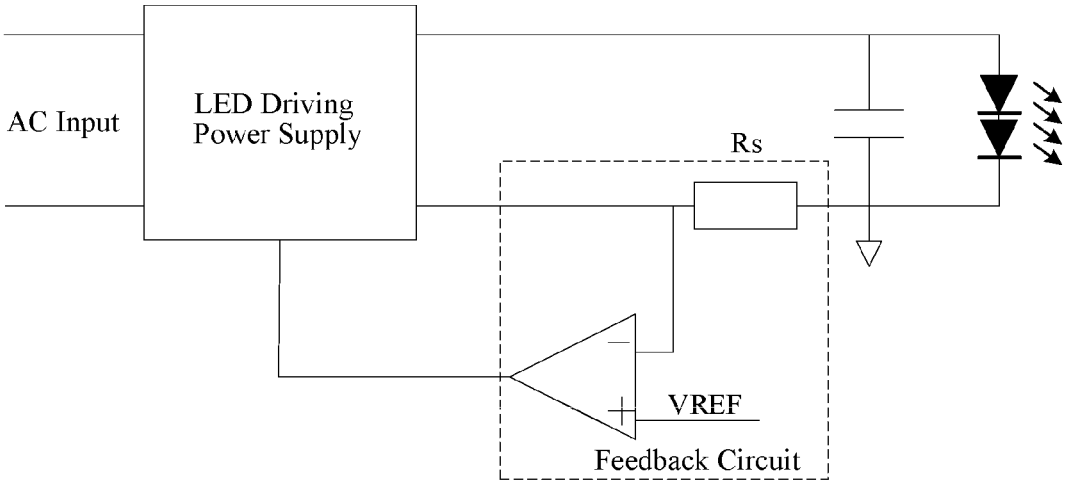
Fig.1 (Prior Art)
FIG. 1 shows a schematic circuit diagram involved in a dimming method in the related art.

Exemplary embodiments will now be described more fully with reference to the accompanying drawings. However, the exemplary embodiments can be embodied in a variety of forms and should not be construed as being limited to the examples set forth herein. Rather, these embodiments are provided so that this disclosure will be more thorough and complete, and to fully convey the concept of the exemplary embodiments to those skilled in the art. The terms "first", "second", "third", "fourth", etc. (if present) in the description and claims of the present application as well as the above-mentioned figures are used to distinguish between similar objects, and are not necessarily used to describe a particular order or sequence. The described features, structures, or characteristics may be combined in any suitable manner in one or more embodiments. In the following description, numerous specific details are set forth to facilitate thorough understanding of the embodiments of the present disclosure. However, one skilled in the art will appreciate that one or more of the specific details may be omitted or other methods, components, devices, steps, etc. may be implemented. In other instances, technical solutions well known in the art will not be illustrated or described in detail, to avoid obscuring the various aspects of the present disclosure.

In addition, the drawings are merely schematic representations of the present disclosure and are not necessarily drawn to scale. The same reference numerals in the drawings denote the same or similar parts, and the repeated description thereof will be omitted. Some of the block diagrams shown in the figures are functional entities and do not necessarily have to correspond to entities that are physically or logically separated.

The lighting equipment, for example, LED (Light Emitting Diode) is a non-linear device, and small variation of voltage on the LED will cause great changes on the current flowing through the LED. Therefore, the output of the power supply of LED is usually constant current control, and the brightness of the LED can be adjusted by the output current. The existed dimming techniques typically are linear dimming and PWM (Pulse Width Modulation) dimming.

FIG. 1 shows a schematic circuit diagram of linear dimming. The LED driving power supply operates in a constant current control, and by linearly changing the given value VREF of the feedback circuit, the output current of the LED driving power supply can change linearly with VREF, thereby adjusting the brightness of the LED.

Figure 2:
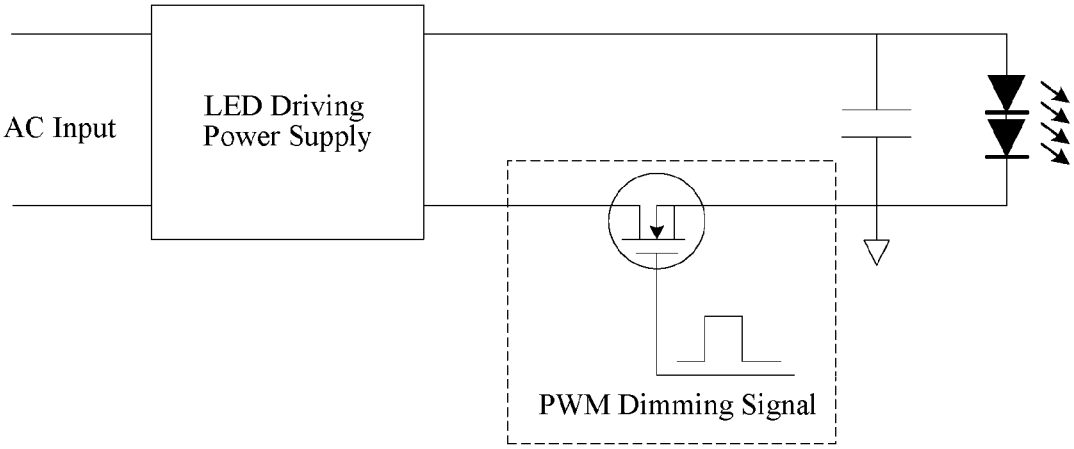
Fig.2 (Prior Art)
FIG. 2 shows a circuit diagram involved in another dimming method in the related art.

FIG. 2 shows a schematic circuit diagram of PWM dimming. As shown in FIG. 2, a main switch is connected in series at the output side of the LED driving power supply. Instead of changing the current setting value, the main switch is controlled to be on or off by a PWM dimming signal with a certain frequency. In other words, the output current can be chopped by the main switch. By changing the duty cycle of the PWM dimming signal, the average value of the output current can be adjusted to change the brightness of the LEDs. Wherein, the frequency of the PWM dimming signal should be set above 200 Hz so that the human eyes cannot sense the blinking of the LEDs.

Specifically, for linear dimming, the dimming range is closely related to the loss of the sampling resistor Rs. In the case where a wide range of dimming is required, in order to achieve a sufficiently deep dimming, the resistance of the sampling resistor Rs has to be chosen large. With the increase of the output current, the loss on the sampling resistor Rs increases correspondingly. Generally, the dimming range can only reach 100%~10%, and power frequency ripple is serious. In order to solve the problem of the power frequency ripple, more capacitors are needed to filter the output current, which increases cost and occupies more space in the PCB (Printed Circuit Board). Besides, for PWM dimming, the output current is discontinuous, which causes a low-frequency ripple superimposed on the output current, and the ripple of the output current may not meet the requirement of being less than 1%.

In view of this, the present disclosure provides a multi-mode dimming control method and a dimming circuit, thereby at least partially overcoming the problem of failing to meet the dimming requirements of a wide dimming range and a low output current ripple due to limitations and drawbacks of the related art.

Figure 3:
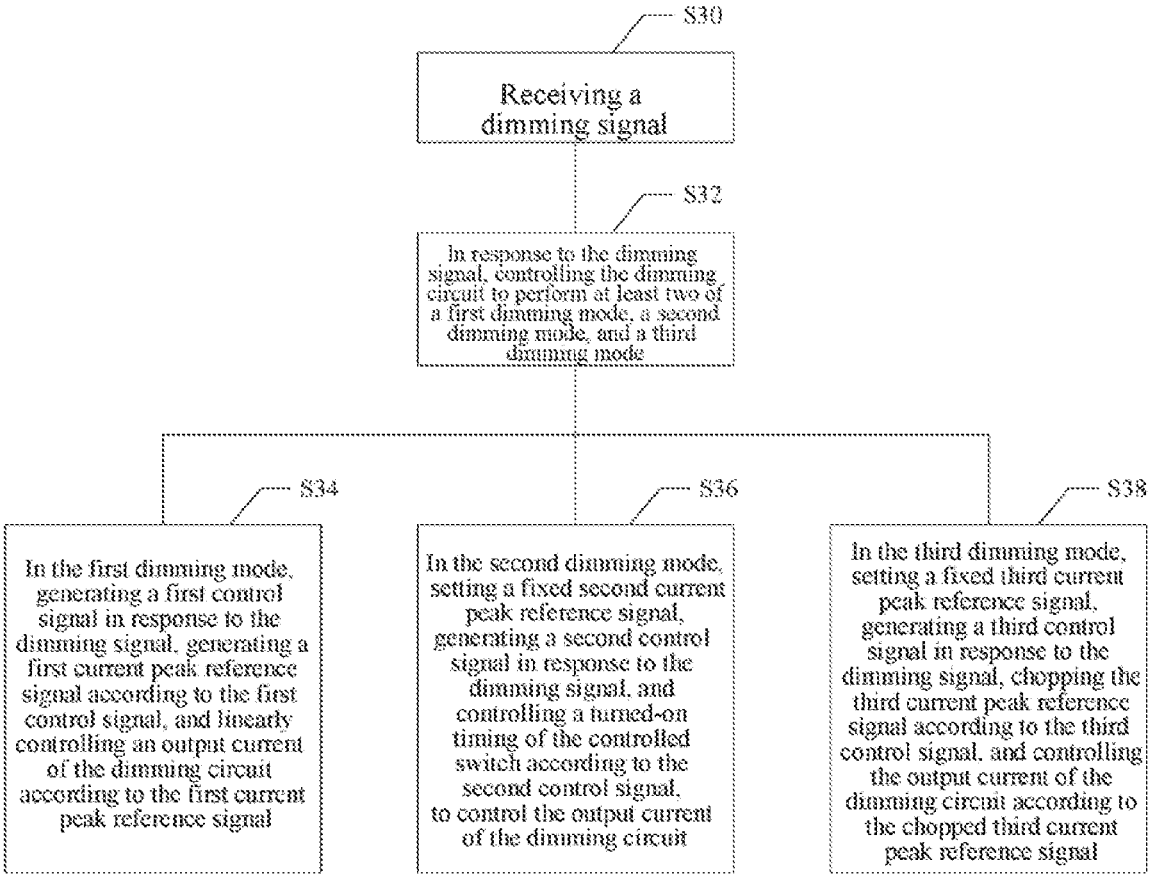
FIG. 3 schematically illustrates a flowchart of a multi-mode current control method according to an exemplary embodiment of the present disclosure.

The multi-mode dimming control method of the present disclosure can be applied to a dimming circuit to adjust brightness of LEDs. The dimming circuit includes at least one main switch. Referring to FIG. 3, the multi-mode dimming control method of an embodiment of the present disclosure may include the following steps.

In S30, receiving a dimming signal.

The dimming signal can be a signal corresponding to the desired brightness. For example, the dimming signal may be a PWM signal, and the duty cycle of the PWM signal represents the degree of the dimming. The dimming signal can be determined by the degree of dimming according to the actual needs of applications, and inputted to the dimming signal processor.

In addition, the dimming signal can also be generated by the dimming circuit according to a predetermined trigger event. For example, the dimming circuit may include one or more ambient light sensors. When the brightness of the ambient changes and the sensors detect the change reaching a preset threshold, the corresponding dimming signal will be generated from the signal generating unit of the dimming circuit.

In S32, controlling the dimming circuit to be operated in a plurality of modes in an arbitrary order according to the dimming signal. The plurality of modes include two or all of a first dimming mode, a second dimming mode, and a third dimming mode.

The dimming mode involved in the present disclosure may include, but is not limited to, a first dimming mode, a second dimming mode, and a third dimming mode. The terms "first", "second", and "third" are used merely to distinguish different modes for achieving dimming, and are not necessarily used to describe a particular order or sequence, which should not be construed as limiting the content of the disclosure.

The first dimming mode, the second dimming mode, and the third dimming mode of the exemplary embodiment of the present disclosure are respectively shown in the form of step S34, step S36, and step S38. It should be understood that, as shown in FIG. 3, there is no sequential relationship between step S34, step S36, and step S38. In some embodiments, for example, the first dimming mode is adopted when the dimming range is 100%~30%, the second dimming mode is adopted when the dimming range is 30%~10%, the third dimming mode is adopted when the dimming range is 10%~1%. And in some embodiments, a fourth dimming mode is adopted when the dimming range is 1%~0.1%. It should be noted that, in the embodiment of the present disclosure, there is no restriction on the order of using any two or all of the first dimming mode, the second dimming mode, and the third dimming mode, and for each dimming mode, there is also no limit to the corresponding dimming range.

In S34, in the first dimming mode, generating a first control signal according to the dimming signal, generating a first peak current reference according to the first control signal, and controlling an output current of the dimming circuit according to the first peak current reference.

In S36, in the second dimming mode, generating a second control signal according to the dimming signal, setting a second peak current reference, and controlling a turn-off time of the main switch according to the second peak current reference and the second control signal, to control the output current of the dimming circuit.

In S38, in the third dimming mode, generating a third control signal according to the dimming signal, setting a third peak current reference, and chopping the third peak current reference according to the third control signal to control the output current of the dimming circuit.

According to some embodiments of the present disclosure, the multi-mode dimming control method of the present disclosure may further include: controlling the dimming circuit to be operated in a fourth dimming mode according to the dimming signal. In the fourth dimming mode, a fourth control signal is generated according to the dimming signal, and the chopped third peak current reference is further chopped according to the fourth control signal to further control the output current of the dimming circuit.

The dimming range of the present disclosure can be further extended by further chopping the chopped third peak current reference according to the fourth control signal.

In some embodiments of the present disclosure, the first control signal, the second control signal, the third control signal, and the fourth control signal may be PWM signals. For example, for different dimming signal, every control signal has different duty cycle. Further, in some embodiments, the second peak current reference may be a minimum of the first peak current reference. In some embodiments, the third peak current reference may be a minimum of the first peak current reference.

In the multi-mode dimming control method of the present disclosure, at least two of the first dimming mode, the second dimming mode, and the third dimming mode may be combined in an arbitrary order to achieve a wide dimming range and a low output current ripple to meet different requirements of lighting applications.

Figure 4:
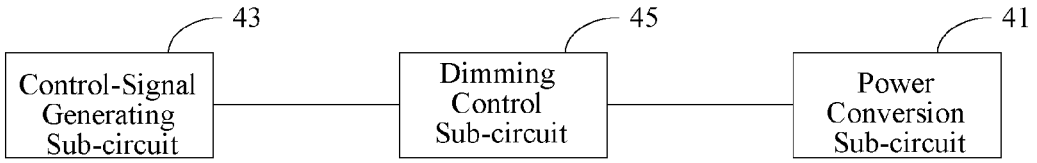
FIG. 4 schematically shows a block diagram of a dimming circuit according to an exemplary embodiment of the present disclosure.

Further, the present disclosure also provides a dimming circuit for adjusting the brightness of the LEDs. Referring to FIG. 4, the dimming circuit of the present disclosure may include a power conversion unit 41, a dimming signal processor 43, and a dimming controller 45. The power conversion unit 41 may include at least one main switch. The dimming signal processor 43 can be configured to receive a dimming signal, and generate multiples control signals according to the dimming signal. The dimming controller 45 is electrically connected to the dimming signal processor 43 to generate a driving signal according to the corresponding control signal and output the driving signal to the main switch.

The dimming circuit can be operated in a plurality of modes in any order. The multiple modes include any two or all of a first dimming mode, a second dimming mode, and a third dimming mode. In the first dimming mode, the dimming signal processor 43 may generate a first control signal according to the dimming signal. The dimming controller 45 may generate a first peak current reference according to the first control signal, and control an output current of the dimming circuit according to the first peak current reference. In the second dimming mode, the dimming signal processor 43 may generate a second control signal according to the dimming signal. The dimming controller 45 may set a second peak current reference, and control a turn-off time of the main switch in the power conversion unit 41 according to the second peak current reference and the second control signal, to control the output current of the dimming circuit. In the third dimming mode, the dimming signal processor 43 may generate a third control signal according to the dimming signal. The dimming controller 45 may set a third peak current reference, chop the third peak current reference according to the third control signal, and control the output current of the dimming circuit according to the chopped third peak current reference.

Further, the dimming controller 45 includes a control chip, and the control chip may have a reference-signal input terminal, a driving-signal output terminal, a ZCD (Zero Current Detection) detection terminal and sampling signal terminal. In some embodiments, the control chip can be a BUCK control chip, and the control chip may be an existing chip.

In some embodiments, the dimming controller 45 may further include a first dimming unit. The first dimming unit may be electrically connected to the reference-signal input terminal of the control chip. The first dimming unit receives the first control signal and outputs a first peak current reference to the reference-signal input terminal of the control chip.

In some embodiments, the dimming controller 45 may further include a second dimming unit. The second dimming unit may be electrically connected to the ZCD detection terminal of the control chip and the second dimming unit receives the second control signal to turn on the main switch.

In some embodiments, the dimming controller 45 may further include a third dimming unit. The third dimming unit may be electrically connected to the reference-signal input terminal of the control chip, and receive the third control signal to chop the third peak current reference.

According to some embodiments of the present disclosure, in the first dimming mode, the first control signal is a PWM signal, the second control signal is a low level voltage, and the third control signal is a low level voltage.

According to some embodiments of the present disclosure, in the second dimming mode, the second peak current reference is a minimum value of the first peak current reference, and the third control signal is a low level.

According to some embodiments of the present disclosure, in the third dimming mode, the third peak current reference is the minimum value of the first peak current reference.

According to some embodiments of the present disclosure, the dimming controller 45 may further include a fourth dimming unit. The fourth dimming unit may be electrically connected between the reference-signal input terminal of the control chip and the third dimming unit, and receive the fourth control signal to further chop the chopped third peak current reference.

With the dimming circuit of the present disclosure, on one hand, the first dimming mode, the second dimming mode, and the third dimming mode may be combined in an arbitrary order to achieve a wide dimming range and a low output current ripple to meet different requirements of lighting applications. On the other hand, the dimming circuit of the present disclosure has a simple hardware structure and a flexible control mode.

Figure 5:
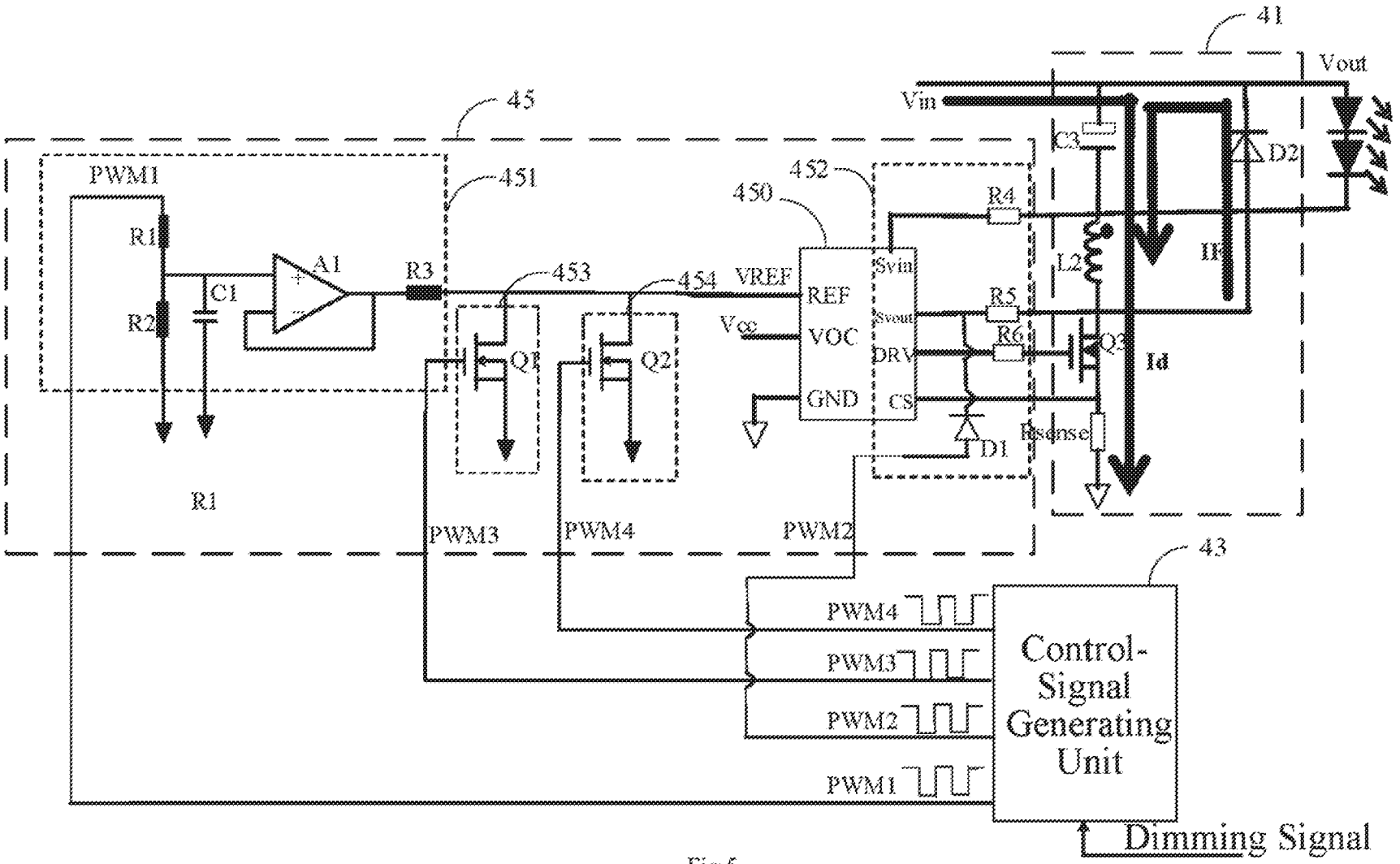
FIG. 5 schematically shows a circuit diagram of a dimming circuit according to an exemplary embodiment of the present disclosure.

FIG. 5 schematically shows a circuit diagram of a dimming circuit according to an exemplary embodiment of the present disclosure.

As shown in FIG. 5, the dimming circuit includes a power conversion unit 41 which receives an input voltage $V_{in}$ and output an output voltage $V_{out}$ to the LEDs. In the embodiment, the power conversion unit 41 is a BUCK circuit including a main switch Q3, a diode D2, an inductor L2 and a capacitor C3. The capacitor C3, the inductor L2 and the main switch Q3 are connected in serious between the input terminal Vin and ground terminal. The cathode of the diode D2 is connect with the input terminal $V_{in}$, and the anode of the diode D2 is connected to the common node of the main switch Q3 and inductor L2. The LEDs are connected in parallel with the capacitor C3. The main switch Q3 may be a MOSFET or IGBT. It should be noted that the present disclosure does not limit the specific circuit of the power conversion unit.

The dimming circuit further includes a dimming signal processor 43 and a dimming controller 45. In this embodiment, the dimming signal processor 43 may be an MCU (Microcontroller Unit) configured to receive a dimming signal, and generate corresponding control signal according to the dimming signal. For example, control signals PWM1, PWM2, PWM3, and PWM4 correspond to the first control signal, the second control signal, the third control signal, and the fourth control signal, respectively. Similarly, the number of control signals generated by the dimming signal processor 43 may be adjusted according to the mode in which the dimming circuit actually needs to operate.

The dimming controller 45 includes a control chip 450, and the control chip 450 may be an existed BUCK control chip. The control chip 450 is equipped with at least a reference-signal input terminal REF, a driving-signal output terminal DRV, a sampling signal terminal CS and a ZCD detection terminal. Further, the reference-signal input terminal REF receives a peak current reference. In this embodiment, as shown in FIG. 4, the Svin pin and Sout pin are cooperated with each other to form the ZCD detection terminal to implement the ZCD function. The sampling signal terminal CS is electrically connected with the main switch Q3 and a sampling resistor Rsence to detect the current flowing through the main switch Q3. The driving-signal output terminal DRV is connected to the control terminal of the main switch Q3. The control chip 450 can output driving signal to control the main switch Q3 according to the input signal of different terminals. Generally, in some embodiments, when the signal received by the sampling signal terminal CS reaches the peak current reference received by reference-signal input terminal REF, the control ship 450 turns off the main switch Q3. When the ZCD detection terminal detects the zero crossing point, the control ship 450 turns on the main switch Q3.

Further, the dimming controller 45 includes a first dimming unit 451, a second dimming unit 452, a third dimming unit 453, and a fourth dimming unit 454. Specifically, the first dimming unit 451 is electrically coupled between the dimming signal processor 43 and the control chip 450. The first dimming unit 451 receives the first control signal PWM1 and outputs the first peak current reference to the reference-signal input terminal REF. The second dimming unit 452 is coupled between the dimming signal processor 43 and the control chip 450. The second dimming unit 452 receives the second control signal PWM2. The third dimming unit 453 is coupled between the first dimming unit 451 and the reference-signal input terminal REF of the control chip 450. The fourth dimming unit 454 is coupled between the third dimming unit 453 and the reference-signal input terminal REF of the control chip 450.

In the first dimming mode, for example, the dimming range is 100%~30%, that is, the range of the output current can vary from 100% to 30% of rated current. Wherein, the dimming signal can represent dimming range. It should be noted that the present disclosure does not limit the dimming range corresponding to each mode. The dimming signal processor 43 generates a first control signal PWM1 according to the dimming signal, and the first dimming unit 451 receives the first control signal PWM1 and outputs first peak current reference to the reference-signal input terminal REF of the control chip. Meanwhile, the sampling signal terminal CS of the control chip detects the inductor current. In some other embodiments, the detection of the inductor current can also be implemented by other peripheral circuit. The present disclosure does not limit the manner in which the inductor current is sampled. The inductor current will be compared with the first peak current reference input from the reference-signal input terminal REF in the control chip 450. When the inductor current equals to the first peak current reference, the main switch Q3 is turned off. So the peak value of the inductor current is controlled by changing the first peak current reference, thereby the average value of the output current can be adjusted. Specifically, as shown in FIG. 5, the first dimming unit 451 includes a first resistor R1, a second resistor R2, a filter capacitor C1, an operational amplifier A1, and a third resistor R3.

Figure 6:
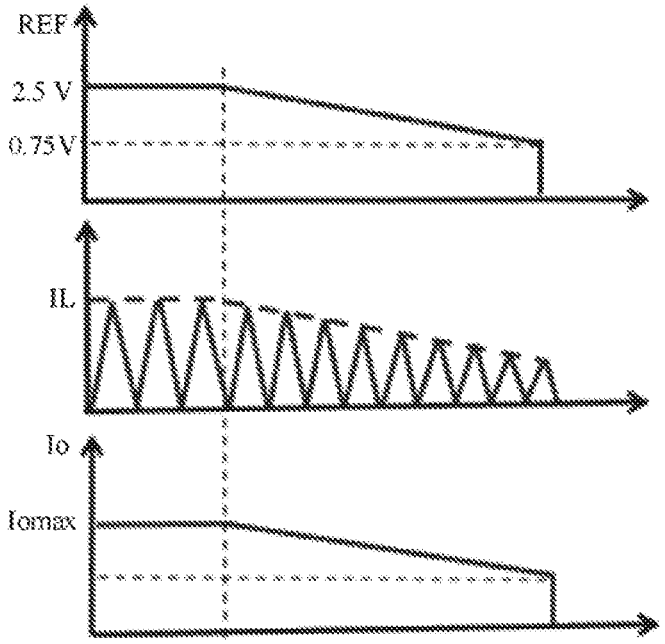
FIG. 6 schematically shows waveforms of an output current, an inductor current and a first peak current reference in a first dimming mode according to an exemplary embodiment of the present disclosure.

FIG. 6 shows waveforms of inductor current, output current and first peak current reference in the first dimming mode. In FIG. 6, IL is the inductor current, Io is the output current, and Io max is the maximum value of the output current. For example, when the required dimming range is 100%~30%, the duty ratio of the first control signal PWM1 can be set from 100% to 30%, and the first peak current reference can be linearly changed from 2.5 V to 0.75 V. For example, with the decreasing of the duty cycle of the first control signal PWM1, the first peak current reference decreases correspondingly, and finally the peak value of the inductor current and the output current follows a linear change with the first control signal PWM1. Further, in the first dimming mode, the output current Io can be represented by Formula (1):

$$Io = \frac{Vref'}{2.5} * Io\ \max \tag{1}$$

Wherein the Io max is the maximum value of the output current, for example, Io max is the value of rated current. Vref' is the first peak current reference according to the first control signal PWM1.

In some embodiments, when the output current needs to vary from 30% to 10%, for example, a second dimming mode can be employed. In some embodiments, the second peak current reference may be the minimum value of the first peak current reference in the first dimming mode. Specifically, the duty ratio of the first control signal PWM1 may be kept at a constant value, for example 30%, that is, the first peak current reference remains unchanged, for example 0.75V, so that the voltage received by the reference-signal input terminal pin REF remains 0.75V. In some other embodiments, the second peak current reference may be preset instead of obtaining from the first dimming unit 451. The dimming controller 45 can set a preset second peak current reference. Due to the voltage received by the reference-signal input terminal pin REF is fixed, the peak value of the inductor current is fixed, and the turn-on time of the main switch Q3 is fixed.

Referring to FIG. 5, the control chip 450 includes a Svin pin and a Sout pin which are cooperated with each other to form the ZCD detection terminal to implement the ZCD function. The Svin pin is coupled to the second terminal of the capacitor C3 and receives a substantially fixed voltage, and the Svout pin is coupled to the common node of the inductor L2 and the main switch Q3 and receives a variable voltage. Further, second dimming unit 452 includes a diode D1 which is coupled between the dimming signal processor 43 and the Svout pin.

Figure 7:
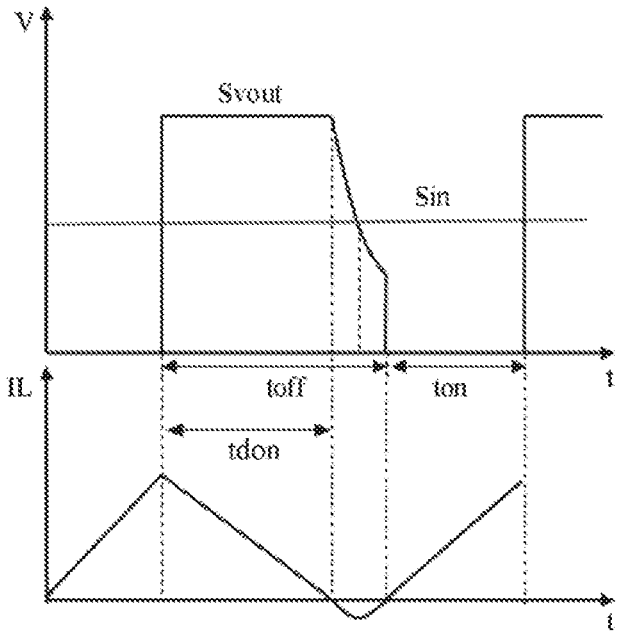
FIG. 7 schematically shows waveforms of signals of a Svin pin and a Svout pin of a control chip and an inductor current in a second dimming mode according to an exemplary embodiment of the present disclosure.
Figure 8:
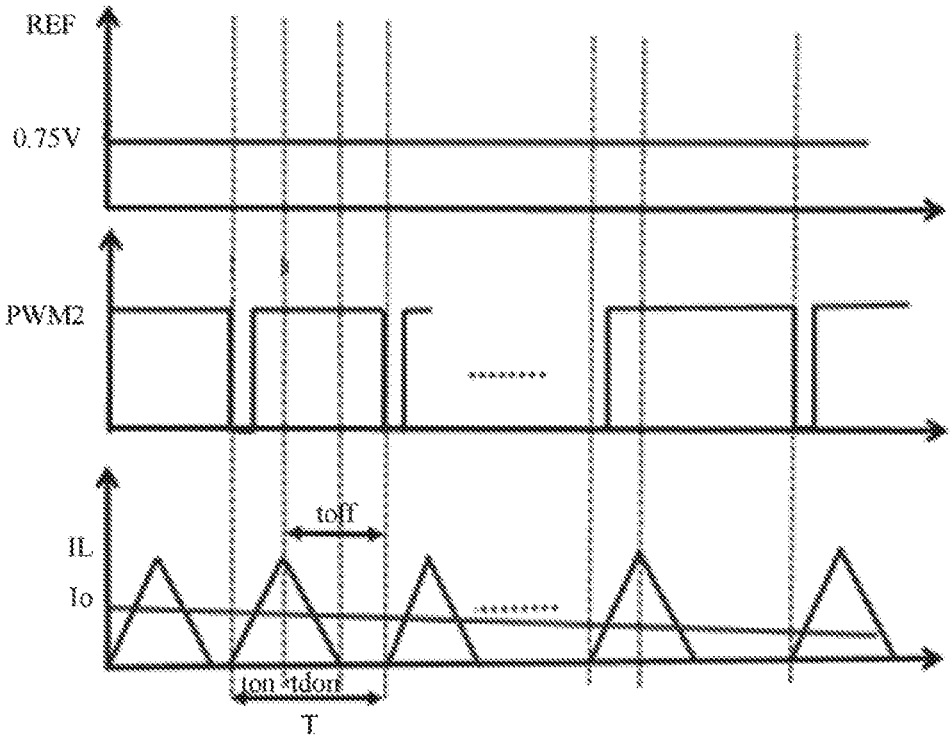
FIG. 8 schematically shows waveforms of a second peak current reference, a second control signal, an inductor current and an output current in a second dimming mode according to an exemplary embodiment of the present disclosure.

Further, the Svout pin enables the ZCD function according to the second control signal PWM2. Specifically, when PWM2 is at a high level, the ZCD detection function is disenabled; when PWM2 is at a low level, the ZCD detection function is enabled. Further, when the PWM2 is at a high level, the main switch Q3 is kept off. When the voltage level of PWM2 is changed from high level to low level, and the voltage of the Svout pin is lower than the voltage of Svin, the main switch Q3 is turned on, as shown in FIG. 7-8. Therefore, the turn-off time of the main switch Q3 can be adjusted by controlling the duty cycle of the second control signal PWM2. In some embodiments, the duty cycle of PWM1 can be kept constant at 30%, so that the voltage of the VREF pin remains unchanged at 0.75 V, that is, the peak value of the inductor current remains unchanged. In other embodiments, the circuit in the first dimming mode may not be utilized. That is, a preset fixed second peak current reference, such as 0.75V, may be additionally provided.

The output current Io at this mode can be represented by Formula (2):

$$Io = \frac{I_{peak}}{2} * \frac{t_{on} + t_{don}}{T} \tag{2}$$

Where $I_{peak}$ is the second peak current reference, $t_{on}$ is the turn-on time of the main switch Q3 in one cycle, $t_{don}$ is the time from the main switch Q3 being turned off to the time when the inductor current flows to zero in one cycle, and T is the switching period. By continuously increasing the duty cycle of the second control signal PWM2, the time of PWM2 with high level is increased, and the time during which the function of ZCD is disabled is increased. So the turn-off time of the main switch Q3 is extended, the switching period becomes longer, and the output current is gradually reduced, thereby adjusting the brightness of the LED.

Figure 9:
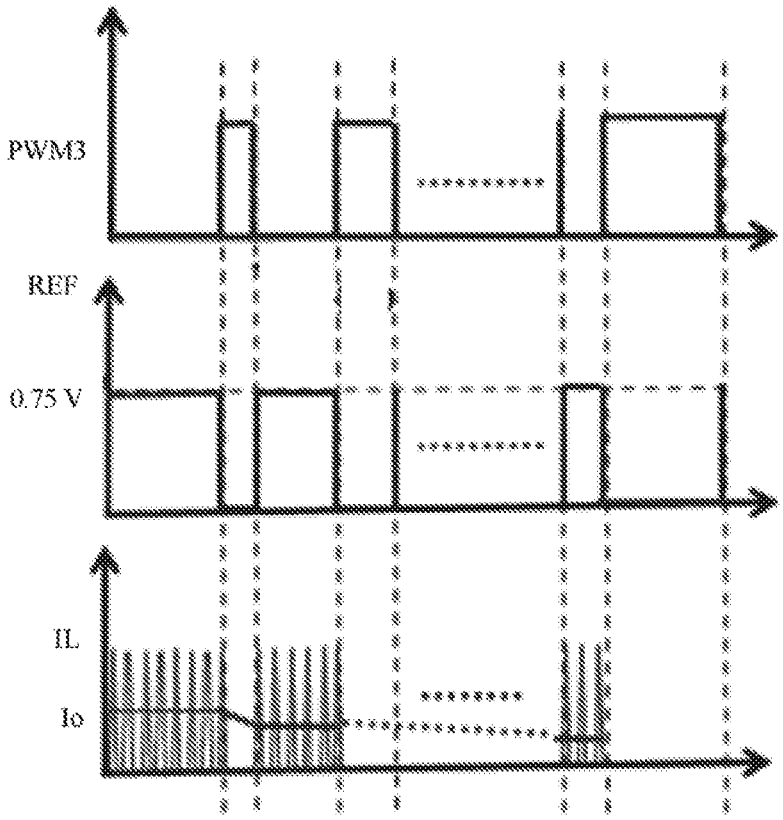
FIG. 9 schematically shows waveforms of a third control signal, a chopped third peak current reference, an inductor current and an output current in a third dimming mode according to an exemplary embodiment of the present disclosure.

In some embodiments, when the output current varies from 10% to 1%, for example, the third dimming mode is employed. Wherein, the third peak current reference may be a minimum value of the first peak current reference in the first dimming mode. For example, the duty ratio of the first control signal PWM1 remains unchanged at 30%, that is, the voltage at the reference-signal input terminal, i.e. the REF pin, is 0.75 V In some other embodiments, a fixed third peak current reference, such as 0.75V, may be additionally provided. That is, the third peak current reference is preset instead of employing the first dimming unit 451. Similarly, in some embodiments, the second control signal PWM2 can be maintained at a fixed duty cycle, such as a minimum value in the second dimming mode. Referring to FIG. 5, the third dimming unit 453 is electrically connected to the reference-signal input terminal REF of the control chip 450 and the first dimming unit 451. In some embodiments, the third dimming unit 453 includes a controlled switch Q1 coupled to between the REF pin and the ground, and the controlled switch Q1 is controlled by the third control signal PWM3. When the third control signal PWM3 is at a high level, the controlled switch Q1 is turned on, and the voltage VREF of the REF pin is zero. When the third control signal PWM3 is at a low level, the controlled switch Q1 is turned off, and the voltage VREF of the REF pin is 0.75 V. That is to say, by turning on and off the controlled switch Q1 with different duty cycle, the voltage VREF of the reference-signal input terminal (REF pin), can be set to a high level (0.75 V) or a low level (0V). FIG. 9 schematically shows waveforms of the third control signal, the voltage VREF of the REF pin, the inductor current and the output current in the third dimming mode. The third peak current reference is chopped by the third control signal PWM3 with a duty ratio, when the PWM3 is in low level, the main switch Q3 is turned on or off normally; when the PWM3 is in high level, the main switch Q3 does not work. Therefore, by adjusting the duty cycle of the PWM3, the output current is adjusted to achieve brightness adjustment of the LEDs.

Figure 10:
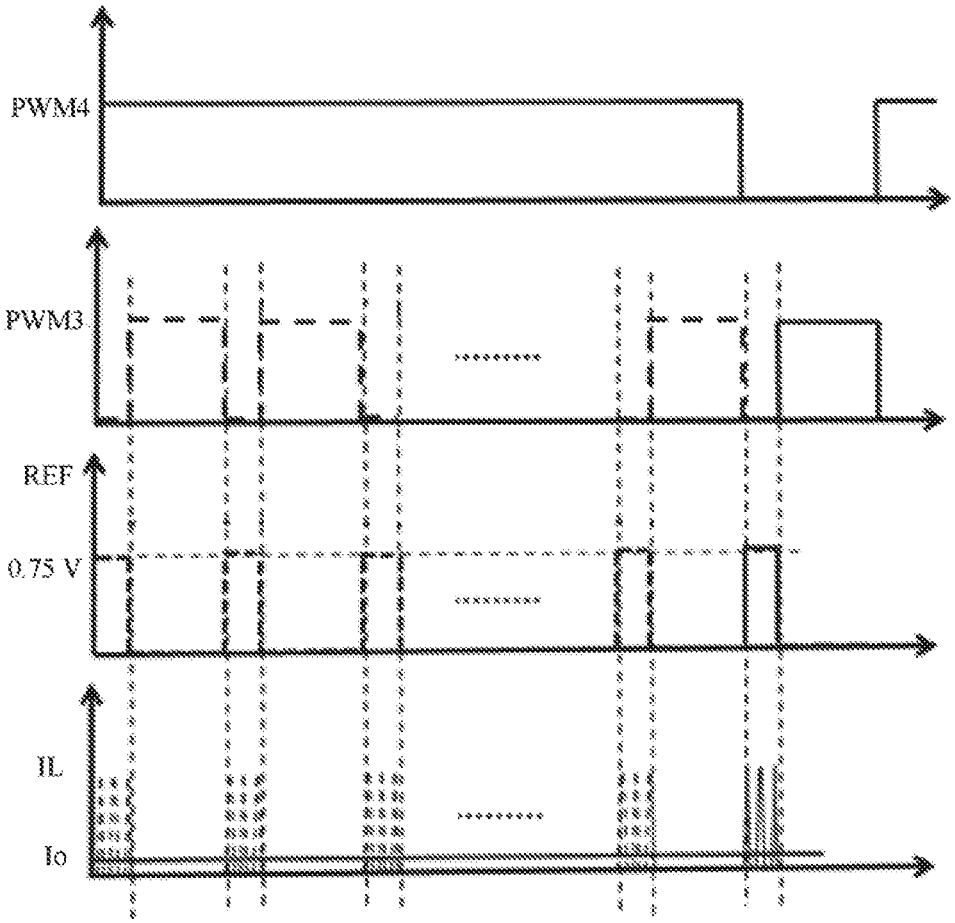
FIG. 10 schematically shows waveforms of a third control signal, a fourth control signal, an inductor current and an output current in a fourth dimming mode according to an exemplary embodiment of the present disclosure.

In order to meet the needs of a wider dimming range, the fourth dimming mode can be adopted. The dimming controller 45 further includes a fourth dimming unit 454 electrically connected to the reference-signal input terminal REF pin of the control chip 450 and the third dimming unit 453. The fourth dimming unit 454 can be a controlled switch Q2. The dimming signal processor 43 generates a fourth control signal PWM4 according to the dimming signal. And the controlled switch Q2 is controlled by the fourth control signal PWM4 with a lower frequency compared with the third control signal PWM3. Similarly, when the fourth control signal PWM4 is at a high level, the controlled switch Q2 is turned on, and the voltage VREF of the REF pin is zero. When the fourth control signal PWM4 is at a low level, the controlled switch Q2 is turned off, and the voltage VREF received by the REF pin is the chopped third peak current reference. So by adjusting the duty cycle of the fourth control signal PWM4, the output current dimming range reaches to 1%~0.1%. For example, the frequency of PWM3 is 1 kHz, and the frequency of the PWM4 is 100 Hz. FIG. 10 schematically shows waveforms of the PWM4, PWM3, VREF, the inductor current and the output current in the fourth dimming mode. When the duty cycle of PWM3 remains a minimum value in the third dimming mode and unchanged, the output voltage of the third dimming unit 453 will be further chopped by the fourth dimming unit 454 with the fourth control signal PWM4. Since one period of PWM4 contains 10 periods of PWM3, the output current becomes one tenth of the minimum current of the third mode. In some embodiments, By chopping the chopped third peak current reference, the output current can reach deeper dimming range, for example 1%~0.1%.

In some embodiment, the first dimming mode, second dimming mode, third dimming mode are all adopted. Taking FIG. 7 as an example, in the first dimming mode, the first control signal is a PWM signal, the duty cycle of which is determined by the dimming signal, and the second control signal is a low level voltage, and the third control signal is a low level voltage. So the first peak current reference is changed with the first control signal, and the output current changes with first peak current reference correspondingly. In the second dimming mode, the duty cycle of the first control signal is fixed, for example, the duty cycle of the first control signal is equal to the minimum duty cycle in the first dimming mode, so the second peak current reference is a minimum value of the first peak current reference. And the third control signal is a low level voltage and does not work. At this time, the second control signal is a PWM signal, the duty cycle of which is determined by the dimming signal, the turn-off time of the main switch is changes with the second control signal, and the output current changes correspondingly. In the third dimming mode, the duty cycle of the first control signal is fixed, for example, the duty cycle of the first control signal is equal to the minimum duty cycle in the first dimming mode, and the third peak current reference is a minimum value of the first peak current reference, and the second control signal is a low level voltage. The third control signal is a PWM signal, the duty cycle of which is determined by the dimming signal, and the third peak current reference is chopped by the third control signal, and the output current changes with the third control signal correspondingly.

Based on the above process, it is easily understood that another signal can be used to further chop the peak current reference in the fourth dimming mode to further expand the dimming range.

Thus, by the combination of the above multi-mode dimming methods, the dimming range can be extended to 100% to 0.1%, and the output current has smaller power frequency ripple.

In some embodiments, the dimming circuit can just operate in two dimming mode, for example, operates in first mode and second mode. It should be noted that, there is no restriction on the order of using any two or all of the first dimming mode, the second dimming mode, and the third dimming mode, and for each dimming mode, there is also no limit to the corresponding dimming range.

The dimming circuit of the present disclosure, on one hand, can be operated in multiple modes in any order. That is, at least two of the first dimming mode, the second dimming mode, and the third dimming mode may be combined in an arbitrary order to achieve a wide dimming range and a low output current ripple to meet different requirements of lighting applications. On the other hand, the dimming circuit of the present disclosure has a simple hardware structure and a flexible control mode.

Other embodiments of the disclosure will be apparent to those skilled in the art from consideration of the specification and practice of the disclosure disclosed here. This application is intended to cover any variations, uses, or adaptations of the disclosure following the general principles thereof and including such departures from the present disclosure as come within known or customary practice in the art. It is intended that the specification and examples be considered as exemplary only, with a true scope and spirit of the disclosure being indicated by the following claims.

It will be appreciated that the present disclosure is not limited to the exact construction that has been described above and illustrated in the accompanying drawings, and that various modifications and changes may be made without departing from the scope thereof. It is intended that the scope of the disclosure only be limited by the appended claims.

What is claimed is:

1. A dimming circuit, comprising:

a power conversion unit comprising at least one main switch;

a dimming signal processor, configured to receive a dimming signal, and generate a control signal according to the dimming signal;

a dimming controller electrically connected to the dimming signal processor, and configured to generate a driving signal according to the control signal, and output the driving signal to the main switch;

wherein the dimming controller controls the power conversion unit to be operated in a plurality of modes in an arbitrary order, the plurality of modes comprise any two or all of a first dimming mode, a second dimming mode, and a third dimming mode, in the first dimming mode, the dimming signal processor is configured to generate a first control signal according to the dimming signal, and the dimming controller is configured to generate a first peak current reference according to the first control signal to control an output current of the dimming circuit;

in the second dimming mode, the dimming signal processor is configured to generate a second control signal according to the dimming signal, and the dimming controller is configured to set a second peak current reference, and control a turn-off time of the main switch according to the second peak current reference and the second control signal, to control the output current of the dimming circuit; and in the third dimming mode, the dimming signal processor is configured to generate a third control signal according to the dimming signal, the dimming controller is configured to set a third peak current reference, and chop the third peak current reference according to the third control signal to control the output current of the dimming circuit.

2. The dimming circuit according to claim 1, wherein the dimming controller comprises:

a control chip including a reference-signal input terminal, a driving-signal output terminal, a sampling signal terminal and a ZCD detection terminal.

3. The dimming circuit according to claim 2, wherein the dimming controller further comprises:

a first dimming unit electrically connected to the reference-signal input terminal of the control chip, and configured to receive the first control signal and output the first peak current reference to the reference-signal input terminal.

4. The dimming circuit according to claim 2, wherein the dimming controller further comprises:

a second dimming unit electrically connected to the ZCD detection terminal of the control chip, and configured to receive the second control signal to turn on the main switch.

5. The dimming circuit according to claim 2, wherein the dimming controller further comprises:

a third dimming unit electrically connected to the reference-signal input terminal of the control chip, and configured to receive the third control signal to chop the third peak current reference.

6. The dimming circuit according to claim 5, wherein in the first dimming mode, the first control signal is a PWM signal, and the second control signal enables ZCD detection, and the third control signal turns off a controlled switch in the third dimming unit.

7. The dimming circuit according to claim 5, wherein in the second dimming mode, the second peak current reference is a minimum value of the first peak current reference, and the third control signal turns off a controlled switch in the third dimming unit.

8. The dimming circuit according to claim 5, wherein the third dimming unit is electrically connected to the first diming unit, and in the third dimming mode, the third peak current reference is a minimum of the first peak current reference, and the second control signal is a low level voltage.

9. The dimming circuit according to claim 8, wherein the dimming controller comprises:

a fourth dimming unit electrically connected between the reference-signal input terminal of the control chip and the third dimming unit, and configured to receive a fourth control signal to further chop the chopped third peak current reference.

10. The dimming circuit according to claim 9, wherein the fourth dimming unit includes a controlled switch.

11. A multi-mode dimming control method for a dimming circuit, the dimming circuit comprising at least one main switch, the method comprising:

receiving a dimming signal;

controlling the dimming circuit to be operated in a plurality of modes in an arbitrary order according to the dimming signal, the plurality of modes comprising any two or all of a first dimming mode, a second dimming mode, and a third dimming mode; wherein, in the first dimming mode, generating a first control signal according to the dimming signal, generating a first peak current reference according to the first control signal, and controlling an output current of the dimming circuit according to the first peak current reference;

in the second dimming mode, generating a second control signal according to the dimming signal, setting a second peak current reference, and controlling a turn off time of the main switch comprised in the dimming circuit according to the second peak current reference and the second control signal, to control the output current of the dimming circuit; and in the third dimming mode, generating a third control signal according to the dimming signal, setting a third peak current reference, and chopping the third peak current reference according to the third control signal to control the output current of the dimming circuit.

12. The multi-mode current control method according to claim 11, further comprising:

controlling the dimming circuit to be operated in a fourth dimming mode according to the dimming signal; and in the fourth dimming mode, generating a fourth control signal according to the dimming signal, and further chopping the chopped third peak current reference according to the fourth control signal to further control the output current of the dimming circuit.

13. The multi-mode current control method according to claim 12, wherein the first control signal, the second control signal, the third control signal, and the fourth control signal are PWM signals.

14. The multi-mode current control method according to claim 11, wherein the second peak current reference is a minimum value of the first peak current reference.

15. The multi-mode current control method according to claim 11, wherein the third peak current reference is a minimum value of the first peak current reference.

* * * * *